US005403018A

United States Patent [19]

Sejnowski et al.

[11] Patent Number: 5,403,018

[45] Date of Patent: Apr. 4, 1995

[54] WATER TOY

[75] Inventors: Joseph P. Sejnowski; Douglas Schultheis, both of Cumberland, R.I.

[73] Assignee: Playskool, Inc., Pawtucket, R.I.

[21] Appl. No.: 80,626

[22] Filed: Jun. 24, 1993

[51] Int. Cl.[6] ..... A63B 67/00

[52] U.S. Cl. ..... 273/394; 273/1.5 A; 446/176; 239/462

[58] Field of Search ..... 273/1.5 R, 1.5 A, 26 R, 273/394, 349, 395, 396, 397; 446/176, 195, 199; 239/461–463, 17, 289

[56] References Cited

U.S. PATENT DOCUMENTS 3,105,683 10/1963 Kimbrell .
3,446,504 5/1969 Pascucci .
3,471,150 10/1969 Kaerwer .
4,946,164 8/1990 Fuller et al. ..... 273/26 R

*Primary Examiner*—Mark S. Graham
*Attorney, Agent, or Firm*—Kurt R. Benson

[57] ABSTRACT

A water toy includes a basket for receiving a ball therein, and a water mechanism for ejecting the ball from the basket. The water mechanism is operative in a first position for emitting a fine spray of water, and in a second position for emitting an upwardly directed high pressure stream of water for ejecting the ball from the basket.

14 Claims, 3 Drawing Sheets

WATER TOY

BACKGROUND OF THE INVENTION

The instant invention relates to the toy art and more particularly to a water toy including a basket for receiving a ball and a water mechanism for ejecting the ball from the basket.

Devices for ejecting balls from baskets have heretofore been known in the art. In this regard, the U.S. patents to Kimbrell U.S. Pat. No. 3,105,683; Pascucci U.S. Pat. No. 3,446,504; and Kaerwer U.S. Pat. No. 3,471,150 represent the closest prior art to the subject invention of which the applicant is aware. The Kimbrell patent discloses a practice device for the game of basketball comprising an ejector mechanism, and a sling for supporting the ejector mechanism inside the rim of a basketball hoop. The ejector mechanism comprises a housing, a plurality of radially extending arms, and a cam assembly for actuating the arms. A motor inside the housing drives the cam assembly which progressively engages and tilts the arms rapidly upwardly so as to eject a ball received in the basketball hoop. The Pascucci patent discloses another practice device including an ejector arm for ejecting a basketball from a basketball net. The Pascucci device includes an electric motor which drives a cam mechanism, and the cam mechanism engages the ejector arm for operation of the device. The Kaerwer patent also relates to a basketball practice device, and it includes a plurality of ball ejector levers which are pivotally supported in a basket ring. When a ball is deposited in the ring, an electric circuit is closed and the ball ejector levers are actuated to forcibly eject the ball from the basket.

SUMMARY OF THE INVENTION

The instant invention provides a water toy including a basket for receiving a ball, and a water driven mechanism for ejecting the ball from the basket.

Briefly, the water toy comprises a basket for receiving a ball therein, a water nozzle in the basket for emitting an upwardly directed pressurized flow of water, and a valve mechanism for controlling the flow of water from the nozzle. The valve mechanism is operative in a first position for emitting a fine spray of water, and it is further operative in a second position for emitting a high pressure stream of water which is capable of ejecting the ball from the basket. The valve mechanism includes a hollow crosshead which is pivotally mounted on the nozzle. The crosshead includes an aperture adjacent to the nozzle and a plurality of upwardly directed spray holes. The valve mechanism further includes a pivot mechanism for automatically cycling the crosshead between the first position wherein the crosshead is positioned over the nozzle, and the second position wherein the crosshead is pivoted away from the nozzle. In the first position, the flow of water from the nozzle enters the crosshead through the aperture, and exits the crosshead through the spray holes to provide an upwardly directed, fine spray of water. In the second position, the crosshead is pivoted away from nozzle, and the nozzle is operative for emitting a high pressure stream of water to eject the ball from the basket.

Accordingly, it is an object of the instant invention to provide a water toy including a basket for receiving a ball and a water mechanism for ejecting the ball from the basket.

It is another object to provide a valve mechanism which is operative in a first position for emitting a fine spray of water, and in a second position for emitting a powerful stream of water.

It is still another object to provide a pivot mechanism for automatically cycling the valve mechanism between a first position and a second position.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
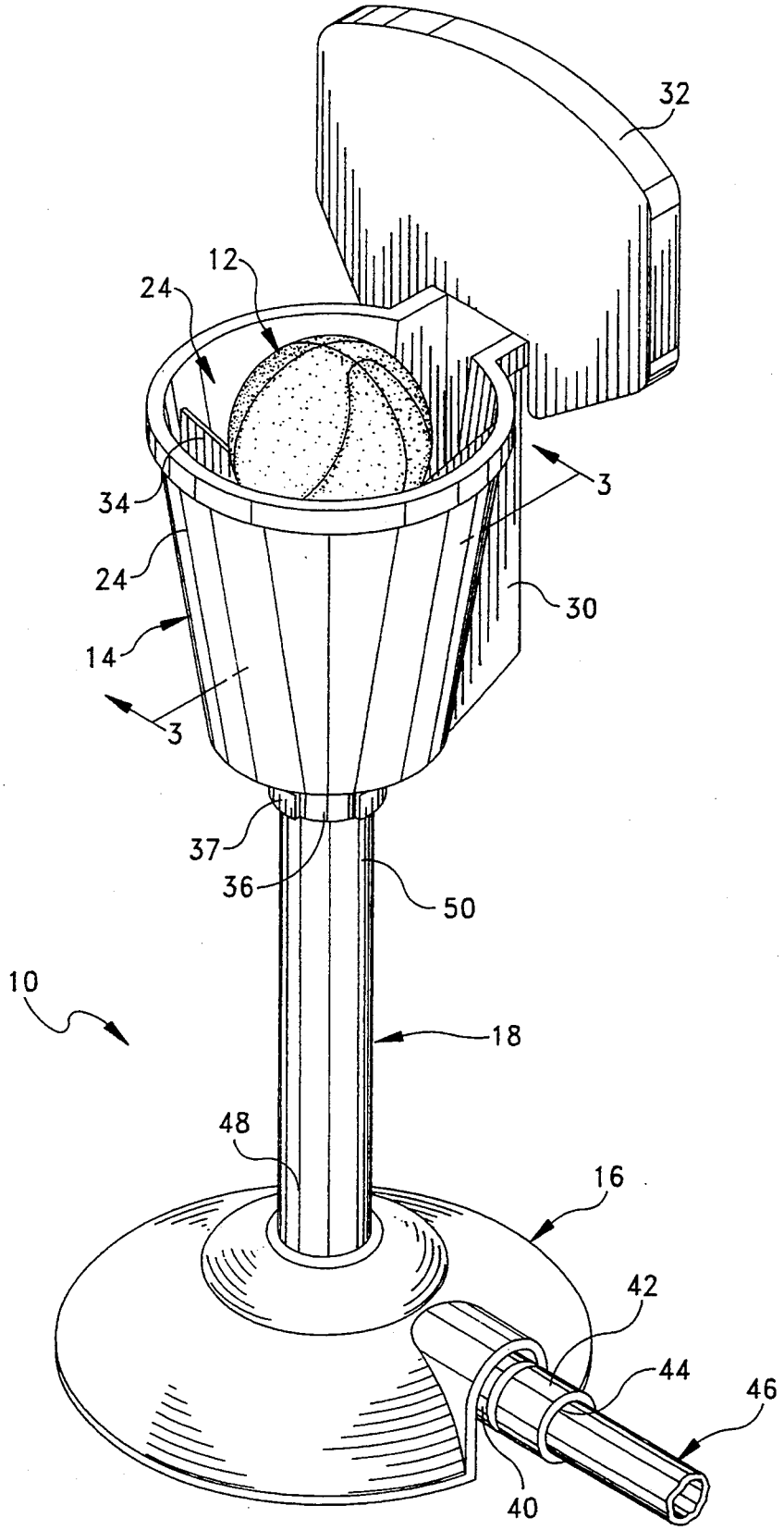
FIG. 1 is a perspective view of the water toy of the instant invention.
Figure 2:
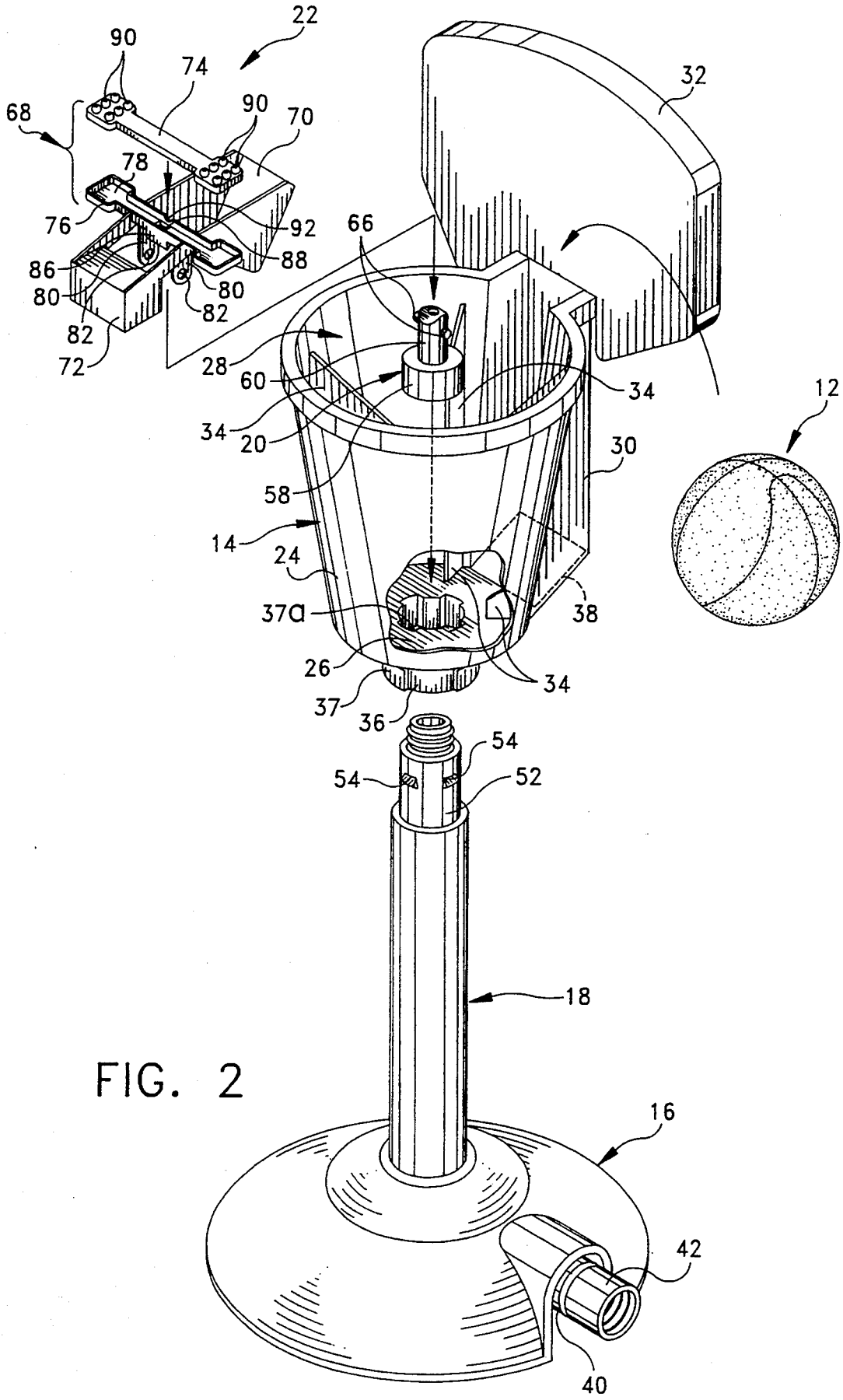
FIG. 2 is an exploded perspective view thereof.

Referring now to the drawings, the water toy of the instant invention is illustrated and generally indicated at 10 in FIGS. 1–4. As will hereinafter be more fully described, a valve mechanism of the water toy 10 is operative in a first position for emitting an upwardly directed fine spray of water, and is further operative in a second position for emitting a high pressure stream of water for ejecting a ball 12 from the toy 10. The water toy 10 comprises a basket generally indicated at 14 for receiving the ball 12 therein, a base generally indicated at 16, a pole element generally indicated at 18 for supporting the basket 14 above the base 16, a water nozzle generally indicated at 20 for emitting an upwardly directed, pressurized flow of water, and a valve mechanism generally indicated at 22 for controlling the flow of water through the nozzle 20.

The ball 12 preferably comprises a lightweight, hollow plastic ball having an outer surface that is contoured to simulate a conventional basketball.

Figure 3:
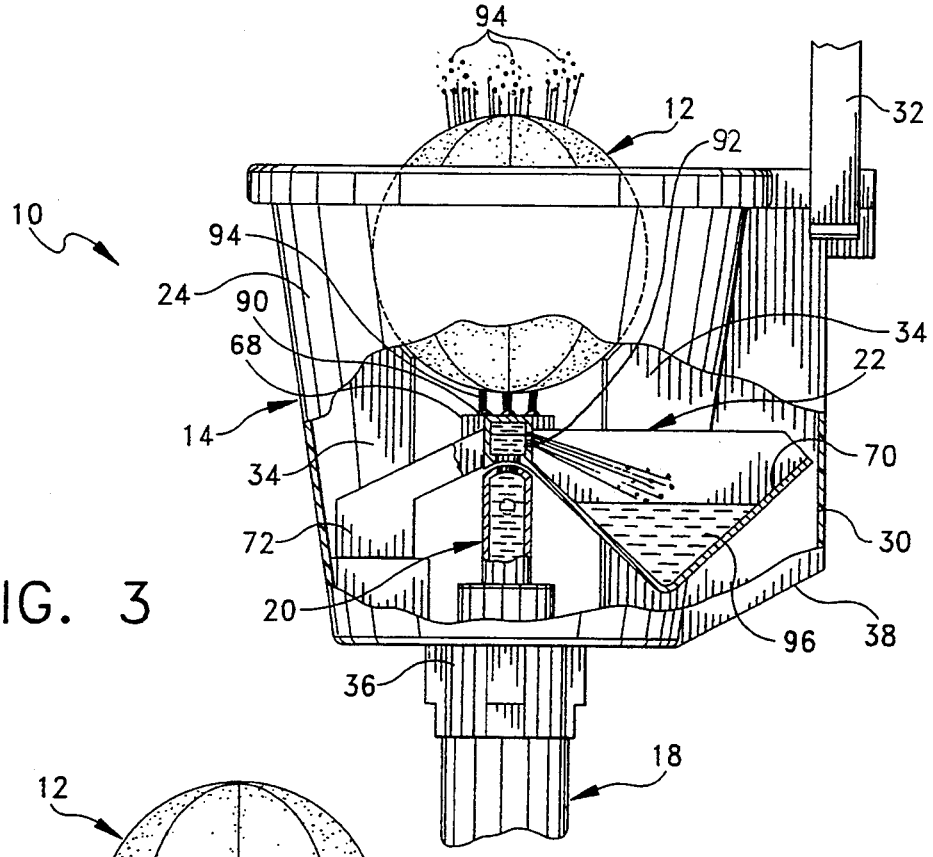
FIG. 3 is a cross sectional view taken along line 3—3 in FIG. 1.
Figure 4:
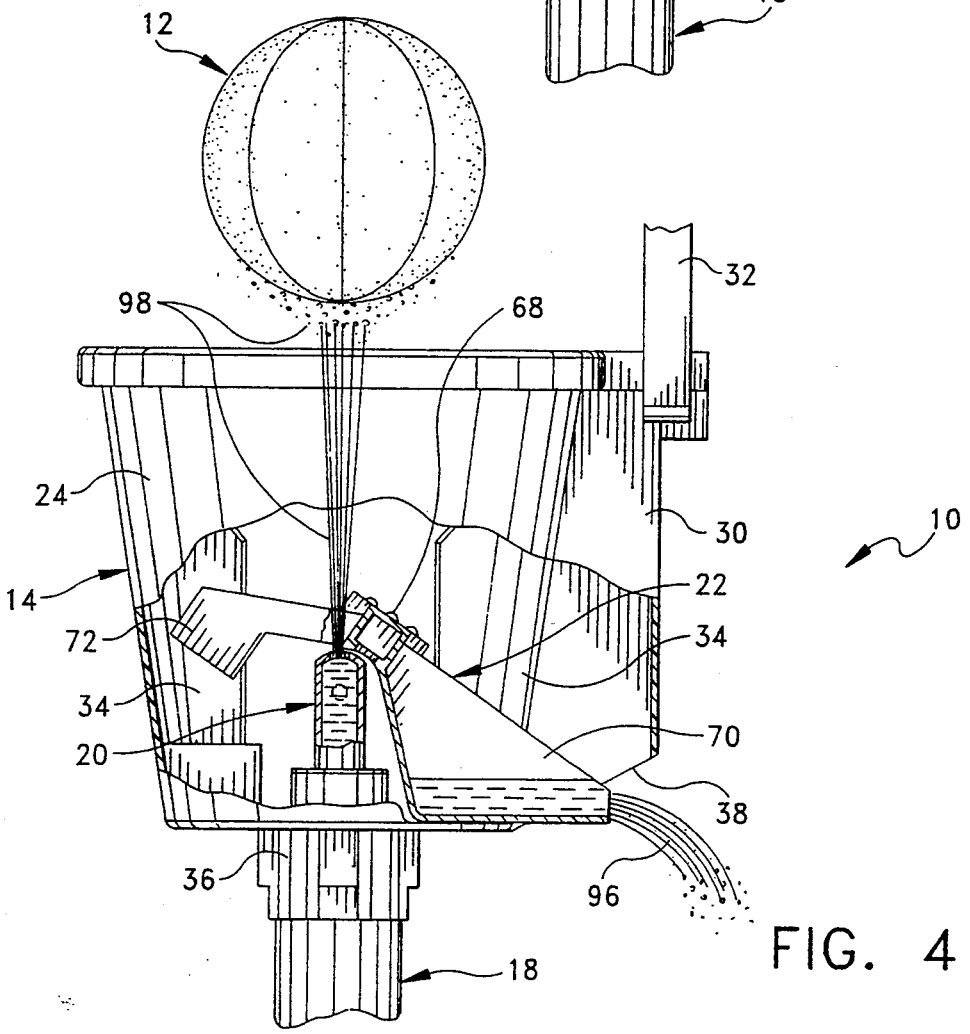
FIG. 4 is a similar view thereof with the ball ejected from the basket.

The basket 14 includes a frustro-conical outer wall 24 and a bottom wall 26 which cooperate to define an upwardly opening interior generally indicated at 28. The interior 28 is operative for receiving the ball 12 therein as illustrated in FIG. 1. The outer wall 24 includes a rectangular appendage 30 which is operative for supporting a vertically disposed backboard element 32 above the basket 14. The basket 14 further includes a plurality of rib-like elements 34 which extend inwardly from the outer wall 24. The rib-like elements 34 are operative for supporting the ball 12 in the interior 28 of the basket 14 so that it is positioned directly over the nozzle 20 (FIG. 3). The bottom wall 26 of the basket 14 includes a downwardly extending tubular projection 36 which is operative for receiving one end of the pole element 18. The tubular projection 36 includes a plurality of radially extending channels 37, and each channel 37 includes a horizontal shoulder portion 37*a*. The rectangular appendage 30 includes a large rectangular opening 38 adjacent the bottom wall 26 of the basket 14. The opening 38 is operative for draining water which may accumulate inside the basket 14.

The base 16 is generally circular in shape, and it is adapted to be received on a supporting surface, such as a lawn or a driveway. The base 16 includes a tubular conduit 40 which extends radially outwardly from a center portion of the base 16. The conduit 40 includes a threaded female hose fitting 42 (FIG. 2) which is connectable to the terminal end 44 of a conventional garden hose 46 (FIG. 1). The hose 46 is operative for supplying pressurized water to the conduit 40.

The pole element 18 is tubular in configuration and it has a first end 48 which is connected to the base 16 and a second end 50 which is adapted to be received in the basket 14. The first end 48 of the tubular pole element 18 extends into the base 16 and communicates with the radial conduit 40 so that water entering the radial conduit 40 is directed upwardly through the tubular pole element 18. The second end 50 of the pole element 18 includes a reduced diameter end portion 52 (FIG. 2) having a plurality of connector tabs 54 thereon and a threaded male nozzle fitting 56. The reduced diameter end portion 52 of the pole element 18 extends through tubular projection 36 on the bottom wall 26 of the basket 14 so that the tabs 54 interfittingly engage with the shoulder portions 37*a* of the channels 37, and the threaded nozzle fitting 56 extends upwardly into the interior 28 of the basket 14.

The nozzle 20 includes a threaded female base portion 58 and a reduced diameter nozzle portion 60. The threaded female base portion 58 is threadedly received on the threaded male nozzle fitting 56 on the pole element 18. The reduced diameter nozzle portion 60 has an arcuate terminal end 62, and an upwardly directed nozzle aperture 64 in the terminal end. The reduced diameter nozzle portion 60 further includes a pair of oppositely disposed pivot pins 66 which extend outwardly therefrom. It can therefore be appreciated that a flow of water introduced through the radial conduit 40 in the base 16 travels upwardly through the pole element 18 and the nozzle 20 and exits the nozzle 20 through the upwardly directed nozzle aperture 64 as a high pressure stream of water.

The valve mechanism 22 comprises a hollow crosshead generally indicated at 68, a water trough 70 extending outwardly from the crosshead 68, and a counterweight element 72 extending outwardly from the crosshead 68 in an opposite direction from the trough 70. The crosshead 68 includes upper and lower body sections 74 and 76 respectively, which are received in interfitting engagement so that they cooperate to define a hollow interior. The lower body section 76 includes a bottom wall 78, and a pair of spaced flanges 80 which extend downwardly therefrom. The flanges 80 each include an aperture 82 at a terminal end thereof, and the apertures 82 are received over the pivot pins 66 on the nozzle 20 to pivotally mount the valve mechanism 22 thereon. The bottom wall 78 further includes an arcuate surface 84 which is slidably received in closely spaced relation over the arcuate terminal end 62 of the nozzle 20. An opening 88 is provided in the arcuate surface 86 so that water exiting the nozzle aperture 64 enters the crosshead 68. The upper body section 74 of the crosshead 68 includes a plurality of upwardly directed spray holes 90. The upper and lower body sections 74 and 76 of the crosshead 68 further cooperate to define a side aperture 92 which is positioned adjacent to the water trough 70. The valve mechanism 22 is pivotable between a first position, shown in FIG. 3, wherein the crosshead 68 is positioned directly over the nozzle 20 and a second position shown in FIG. 4 wherein the crosshead 68 is pivoted away from the nozzle 20.

In operation of the water toy 10, the counter-weight element 72 normally maintains the crosshead 68 in the first position (FIG. 3) wherein a flow of water exiting the nozzle aperture 64 enters the crosshead 68 through the opening 88 and exits the crosshead 68 simultaneously through the upwardly directed spray holes 90 to provide a fine spray of water 94 and through the side aperture 92 to fill the water trough 70. However, when the water trough 70 becomes filled with water 96, the weight of the water 96 overcomes the weight of the counterweight element 72 to pivot the valve mechanism 22 to the second position, wherein the nozzle aperture 64 is unobstructed and operative for emitting an upwardly directed, high pressure stream of water 98 (FIG. 1). Hence, when the ball 12 is received in the basket 14, the stream of water 98 engages the ball 12 for ejecting the ball 12 from the basket 14. Further, when the crosshead 68 is in the second position thereof (FIG. 4), the water trough 70 empties the accumulated water 96 through the opening 38 in the bottom of the rectangular appendage 30 wherein the counterweight element 72 again pivots the crosshead 68 back into position over the nozzle 20 (FIG. 3). It can therefore be appreciated that the valve mechanism 22 is operative for continuously cycling between the first and second positions to alternately emit a fine spray of water and a high pressure stream of water.

It is seen therefore that the instant invention provides an amusing water toy 10. The water toy 10 includes a basket 14 for receiving a ball 12 therein, a nozzle 20 in the basket 14 for emitting a pressurized stream of water, and a valve mechanism 22 for controlling the flow of water through the nozzle 20. The valve mechanism 22 is operative in a first position for emitting a fine spray of water, and in a second position for emitting a high pressure stream of water which is operative for ejecting a ball 12 from the basket 14. The toy 10 is further adapted to be received on a relatively flat surface, such as a lawn, wherein players attempt to shoot the ball 12 into the basket 14. For these reasons it is believed that the water toy 10 of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A toy comprising:

basket means for receiving a ball therein;

nozzle means in said basket means for emitting an upwardly directed flow of water;

means for receiving a supply of pressurized water and for supplying said pressurized water to said nozzle means;

valve means for controlling said flow of water from said nozzle, said valve means including means for emitting a fine spray of water and means for emitting a high pressure stream of water which is operative for ejecting said ball from said basket means, said valve means being movable between a first position wherein said means for emitting a fine spray of water is operative and a second position wherein said means for emitting a high pressure stream of water is operative; and means for automatically cycling said valve means between said first and second positions.

2. In the toy of claim 1, said basket means including an opening therein for draining water which is received in said basket means.

3. In the toy of claim 1, said basket means including a plurality of inwardly extending rib elements adapted for engaging said ball and positioning said ball above said nozzle means.

4. The toy of claim 1 further comprising support means for supporting said basket means above a supporting surface.

5. In the toy of claim 4, said support means comprising a base which is adapted to be received on a supporting surface, and an elongated pole element which is operative for supporting said basket means above said base.

6. In the toy of claim 5, said means for supplying said flow of water to said nozzle means comprising water conduit means extending through said base and said pole element.

7. In the toy of claim 6, said conduit means including a threaded hose fitting for connection to a water hose.

8. In the toy of claim 1, said means for automatically cycling said valve means between said first and second positions comprising:

means for normally maintaining said valve means in said first position;

means for accumulating a predetermined quantity of water while in said first position;

means responsive to said predetermined quantity of water for moving said valve means to said second position; and means for emptying said accumulated water in said second position wherein said valve means is moved to its normal first position, said means for accumulating said water repeatedly filling and emptying in order to cycle said valve means between said first and second positions.

9. A toy comprising:

basket means for receiving a ball therein;

nozzle means in said basket means for emitting an upwardly directed flow of water;

means for receiving a supply of pressurized water and for supplying said pressurized water to said nozzle means;

a hollow crosshead which is mounted adjacent said nozzle means, said crosshead including a bottom opening and a plurality of upwardly directed spray holes, said crosshead being operative in a first position for emitting a fine spray of water and in a second position for emitting a high pressure stream of water which is operative for ejecting said ball from said basket; and means for automatically cycling said crosshead between said first position wherein said bottom opening is positioned over said nozzle means and wherein water enters said crosshead through said opening and exits said crosshead through said spray holes to provide said fine spray of water, and said second position wherein said crosshead is moved away from said nozzle means and said nozzle means is unobstructed and operative for emitting said high pressure stream of water.

10. In the toy of claim 9, said crosshead being pivotably mounted on said nozzle means, said means for automatically cycling comprising means for pivoting said crosshead between said first and second positions.

11. In the toy of claim 10, said means for pivoting comprising:

trough means extending outwardly from said crosshead, said crosshead further including a side aperture adjacent said trough means; and counterweight means extending outwardly from said crosshead in an opposite direction from said trough means, said counterweight means normally maintaining said crosshead in said first position wherein said flow of water simultaneously exits said crosshead through said spray holes and through said side aperture to fill said trough means, said trough means overcoming said counterweight means when filled with water to pivot said crosshead to said second position, said trough means being constructed so as to spill water therefrom in said second position whereby said counterweight means is rendered operative for returning said crosshead to said first position.

12. A toy game comprising:

a ball;

basket means for receiving said ball therein;

nozzle means in said basket means for emitting an upwardly directed flow of water;

means for receiving a supply of pressurized water and for supplying said pressurized water to said nozzle means; and valve means on said nozzle means for controlling said flow of water, said valve means automatically alternating between a first condition in which it is operative for emitting a high pressure stream of water through said nozzle means which is capable of ejecting said ball from said basket means and a second condition in which it is operative for emitting a fine spray of water which is incapable of ejecting said ball from said basket means.

13. A toy comprising:

(a) a ball;

(b) basket means for receiving said ball therein;

(c) nozzle means in said basket means for emitting an upwardly directed flow of water therefrom; and (d) valve means associated with said nozzle means and operable in a first position for causing a stream of water to be emitted through said nozzle means which is sufficient to eject said ball from said basket means and in a second position for causing a stream of water to be emitted through said nozzle means which is insufficient to eject said ball from said basket means, said valve means automatically cycling between said first and second positions thereof.

14. In the toy of claim 13, said valve means including accumulating and emptying means operative when said valve means is in the second position thereof for accumulating a predetermined quantity of water therein and operative for automatically shifting said valve means to the first position thereof for emptying the accumulated water in said accumulating and emptying means when the predetermined quantity of water has been accumulated therein, said accumulating and emptying means automatically shifting said valve means to the second position thereof when the predetermined quantity of water has been emptied therefrom.

* * * * *